US006751980B1

(12) United States Patent
Lopes

(10) Patent No.: US 6,751,980 B1
(45) Date of Patent: Jun. 22, 2004

(54) FORCED AIR FLOW SYSTEM FOR REFRIGERATORS

(75) Inventor: Luiz Antonio Diemer Lopes, Joinville, SC (US)

(73) Assignee: Multibras S. A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 09/980,394

(22) PCT Filed: Jun. 21, 2000

(86) PCT No.: PCT/BR00/00069

§ 371 (c)(1),
(2), (4) Date: Mar. 28, 2002

(87) PCT Pub. No.: WO00/79192

PCT Pub. Date: Dec. 28, 2000

(30) Foreign Application Priority Data

Jun. 22, 1999 (BR) ..... 9903094

(51) Int. Cl.[7] ..... F25D 17/04
(52) U.S. Cl. ..... 62/407; 62/419
(58) Field of Search ..... 62/407, 419; 165/104.18

(56) References Cited

U.S. PATENT DOCUMENTS

| | | | | |
|---|---|---|---|---|
| 3,393,530 A | | 7/1968 | Koch | 62/275 |
| 5,272,884 A | * | 12/1993 | Cur et al. | 62/199 |
| 5,904,049 A | | 5/1999 | Jaster et al. | 62/204 |

FOREIGN PATENT DOCUMENTS

| | | | |
|---|---|---|---|
| DE | 25 40 037 | 5/1976 | F25D/17/06 |
| GB | 808 942 | 2/1959 | |

* cited by examiner

*Primary Examiner*—Melvin Jones
(74) *Attorney, Agent, or Firm*—Darby & Darby

(57) ABSTRACT

An improvement in the forced air flow system for refrigerators, comprising: at least two refrigeration environments (1, 2); and a refrigeration air impelling means (10) forcing the passage of an air flow from a refrigeration environment (1, 2) through a respective evaporator portion (4, 5) and comprising only one fan (11) associated with at least two suction chambers (12), which are each opened to a respective refrigeration environment (1, 2) and to at least two discharge chambers (13), which are each opened to an inlet side (6) of a respective evaporator portion (4, 5).

11 Claims, 4 Drawing Sheets

FORCED AIR FLOW SYSTEM FOR REFRIGERATORS

FIELD OF THE INVENTION

The present invention refers to an improvement in the forced air flow system for refrigerators having at least two refrigeration environments, particularly used in refrigerators and freezers in which the evaporator is provided externally to the refrigeration environments and which have independent refrigeration air circuits communicating each refrigeration environments with the evaporator.

BACKGROUND OF THE INVENTION

In the refrigerators having two or more refrigeration environments, for example a freezing compartment and a refrigerating compartment, and in which the evaporator is provided externally to said refrigeration environments, the refrigeration of the latter is obtained by forced circulation of air flows through the evaporator, said forced circulation being made by an impelling means, usually a fan provided adjacent to an air passage between the freezing and refrigerating compartments.

In some known constructions, the air flow of the different refrigeration environments of the refrigerator is mixed in a return duct of a refrigeration air circuit, which duct is common to said compartments, said air flow being then conducted to the environment of the evaporator and cooled therein, before re-conducted to these compartments. Since the conditions of temperature and air humidity in these environments are distinct, the mixture of air flows to promote the refrigeration of these environments, by passing through the evaporator, results in energetic losses.

In other known constructions, the refrigerator has, for each refrigeration environment, a respective refrigeration air circuit which communicates the air flow of the respective environment with the environment of the evaporator. In these constructions, the air flow of each refrigeration environment is forced to pass through the evaporator, through the respective air circuit, which is provided with a respective fan.

In these constructions, in order that the air flows do not mix, even in the region of the evaporator, it should be provided, for each refrigeration circuit, respective components, including for example, the evaporator, which increases the cost of the product. Besides increasing the cost of the product, a higher number of components makes more complex the assembly of this product and leaves this product more susceptible to failures, requiring more frequent maintenance service.

As a function of the limitations of the available space for installing the components, such constructions require smaller mechanical components, which usually have low efficiency, causing losses. Moreover, a higher number of components allows the occurrence of noises.

DISCLOSURE OF THE INVENTION

Thus, it is an objective of the present invention to provide an improvement in the forced air flow system for refrigerators, which allows a substantial segregation of the forced air flows between the refrigeration environments, with a simple construction, of easy assembly and maintenance, which uses few components, but with a low cost. These and other objectives are achieved by an improvement in the forced air flow system for refrigerators, comprising: at least two refrigeration environments; and refrigeration air impelling means, having a suction side and a discharge side and forcing the passage of an air flow from a refrigeration environment through a respective evaporator portion, each evaporator portion having an outlet side opened to a respective refrigeration environment, the refrigeration air impelling means comprising only one fan associated with at least two suction chambers, which are each opened to a respective refrigeration environment and to at least two discharge chambers, which are each opened to an inlet side of a respective evaporator portion.

BRIEF DESCRIPTION OF THE DRAWINGS

The invention will be described below, with reference to the attached drawings, in which.

BEST MODE OF CARRYING OUT THE PRESENT INVENTION

Figure 1:
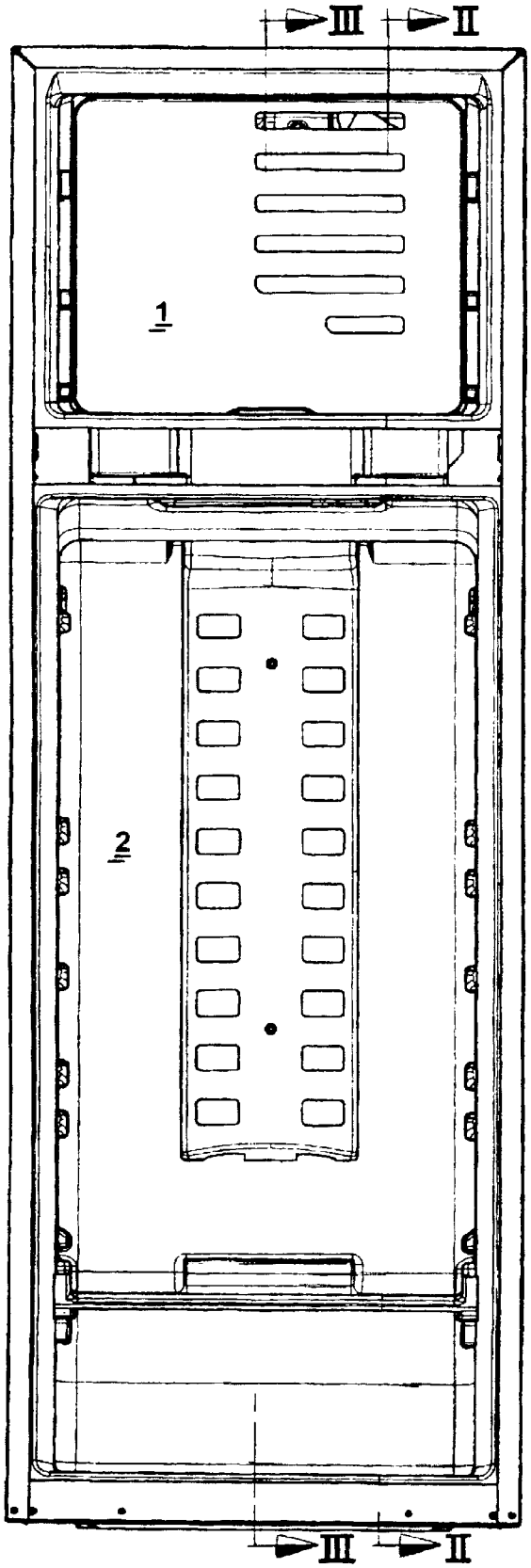
FIG. 1 illustrates, schematically, a front view of a cabinet, without the door, of a refrigerator, in relation to which the present invention will be described.

The present invention will be described in relation to a refrigerator or freezer, such as that disclosed in the copending patent application of the same applicant and filed on Jun. 22, 1999, with the title "An Automatic Defrost System for a Refrigerating Device" and which includes, inside a cabinet, at least two refrigeration environments, for example defined by at least one of the freezing compartment 1 and the refrigerating compartment 2, which are in selective fluid communication with an evaporator 3 (for example provided in an environment external and adjacent to a rear wall of the freezing compartment 1) and whose temperatures are maintained within a temperature interval, which is previously defined as the ideal operation interval, as a function of the operation of a non-illustrated compressor.

The evaporator 3 comprises evaporator portions 4 and 5, each having a respective inlet side 6 operatively connected to and in selective fluid communication with a refrigeration air impelling means 10 of a forced air flow system, to be described below, and an outlet side, in fluid communication with a respective refrigeration environment 1, 2. Each inlet side defines an air chamber associated with a respective air duct in the respective evaporator portion 4, 5 and which is defined between at least two vertical fins 7 adjacent to each other and belonging to the corresponding evaporator portion 4, 5.

In the illustrated construction, the evaporator 3 is of the tube-fin type, with vertical fins 7 arranged parallel to each other defining ducts for the passage of the air flow to be directed to one of the refrigeration environments 1, 2. In this construction, the evaporator 3 comprises a vertical plate 8, provided parallel between the vertical fins of said evaporator 3, separating its two portions, said vertical plate 8 being, for example, defined by a fin of the evaporator 3 having at least one end portion 9 projecting from a plane containing end edges of the same side of the other vertical fins 7 of the evaporator 3.

The refrigeration air impelling means 10 has a suction side and a discharge side and forces the passage of an air flow of each refrigeration environment 1, 2 through a respective evaporator portion 4, 5, each of the latter having a respective outlet side opened to a respective refrigeration environment 1, 2.

The refrigeration air impelling means 10 of the present invention comprises, for example, a single fan 11, associated with at least two suction chambers 12, each being opened to a respective refrigeration environment 1, 2 and to at least two discharge chambers 13, each of the latter being opened to the inlet side 6 of a respective evaporator portion 4, 5. According to the present invention, at least one of the suction 12 and discharge chambers 13 of the refrigeration air impelling means 10 is opened to a nozzle of a respective refrigeration duct 20, which conducts the respective refrigeration air flow to one of the parts defined by the refrigeration environments 1, 2 and inlet side 6 of the evaporator portions 4, 5. In the illustrated construction, the refrigeration air impelling means 10 has two suction chambers 12 and two discharge chambers 13, each suction chamber 12 being axially and substantially aligned with a respective discharge chamber 13 and opened to a nozzle of a respective refrigeration duct 20.

According to the illustrated embodiment, the refrigeration air flow system of the present invention has: two refrigeration ducts 20, each interconnecting a respective refrigeration environment 1, 2 to a suction chamber 12 of the air flow impelling means 10, each refrigeration duct 20 having an inlet nozzle 21 opened to the respective refrigeration environment 1, 2, and an outlet nozzle 22 opened to the respective suction chamber 12; and two refrigeration ducts 20, each interconnecting a discharge chamber 13 of the air flow impelling means 10 to a nozzle on the inlet side 6 of a respective evaporator portion 4, 5, each refrigeration duct 20 having an inlet nozzle 21 opened to a respective discharge chamber 13 of the air flow impelling means 10 and an outlet nozzle 22 opened to the nozzle of the inlet side 6 of a respective evaporator portion 4, 5.

Figure 4:
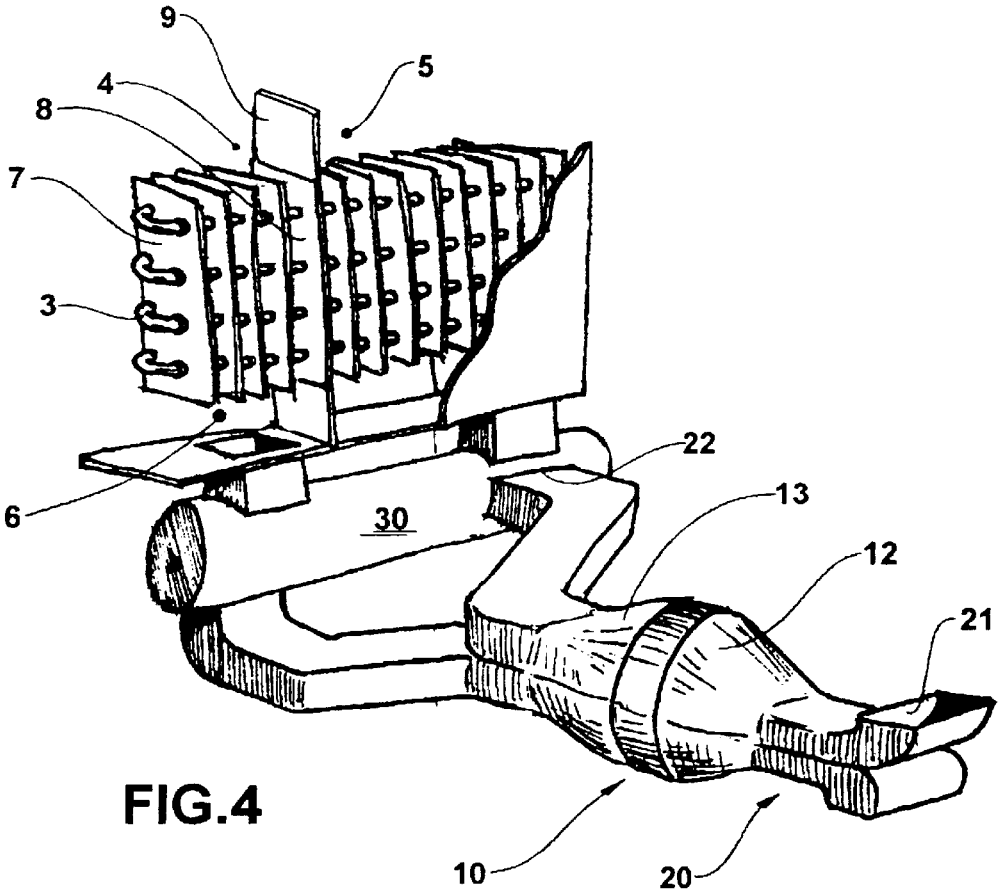
FIG. 4 illustrates, schematically and in a perspective view, the part of the air flow system of the present invention, showing the evaporator, the refrigeration ducts and the impelling means.

The refrigeration ducts 20 interconnecting the air flow impelling means 10 to the evaporator 3 have their respective inlet nozzles 21 vertically aligned to each other and their outlet nozzles 22 horizontally and vertically spaced from each other, each one opened to a nozzle of a valve means 30 containing an obturator for each said outlet nozzle 22 and constructed, for example, such as that described in the copending patent application, of the same applicant, filed on Jun. 22, 1999, under the title "An Automatic Defrost System for a Refrigerating Device" (FIG. 4).

Figure 2:
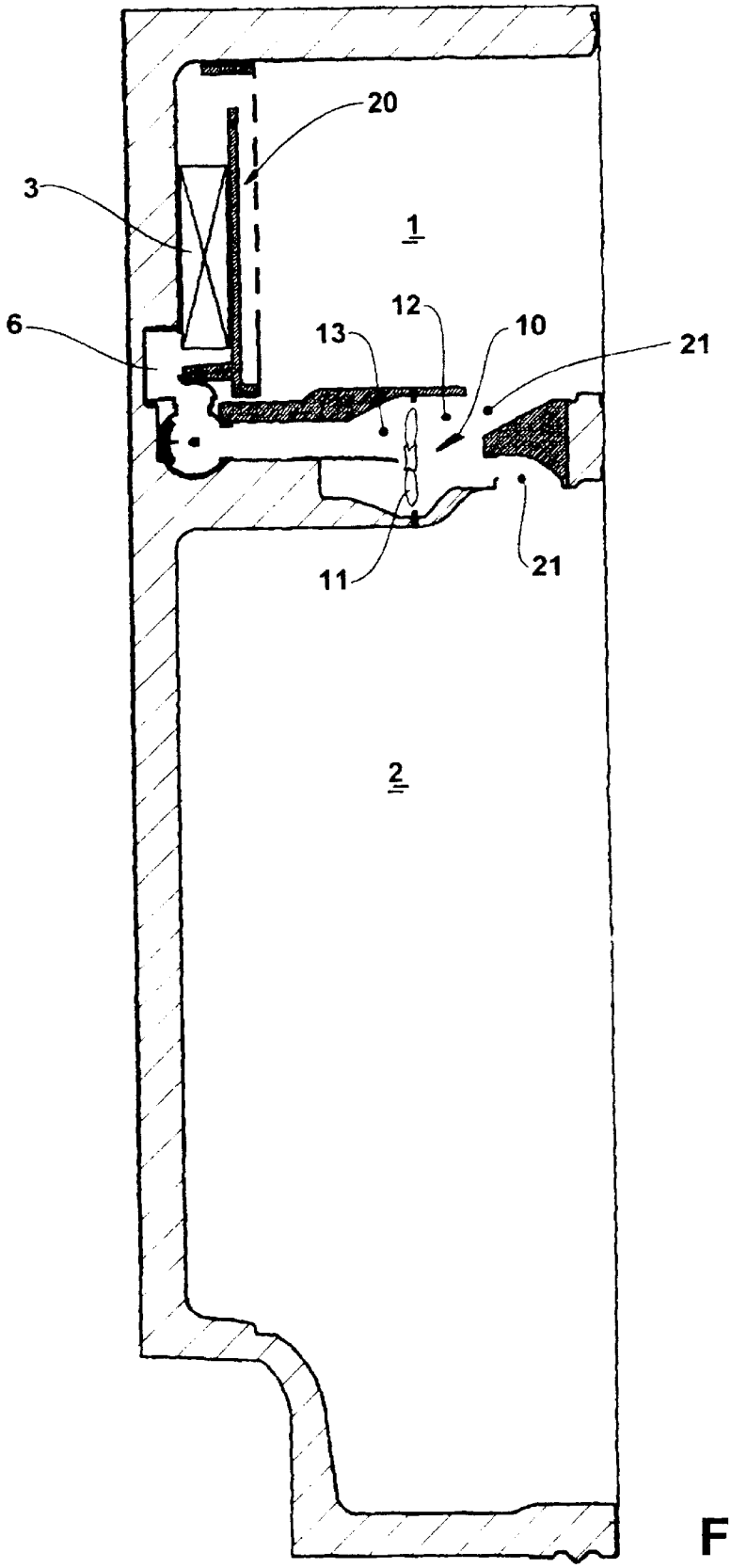
FIG. 2 illustrates, schematically and in a lateral longitudinal sectional view, according to line II—II of FIG. 1, showing the impelling means of the present invention and part of a refrigeration circuit for the freezing compartment of the refrigerator.
Figure 3:
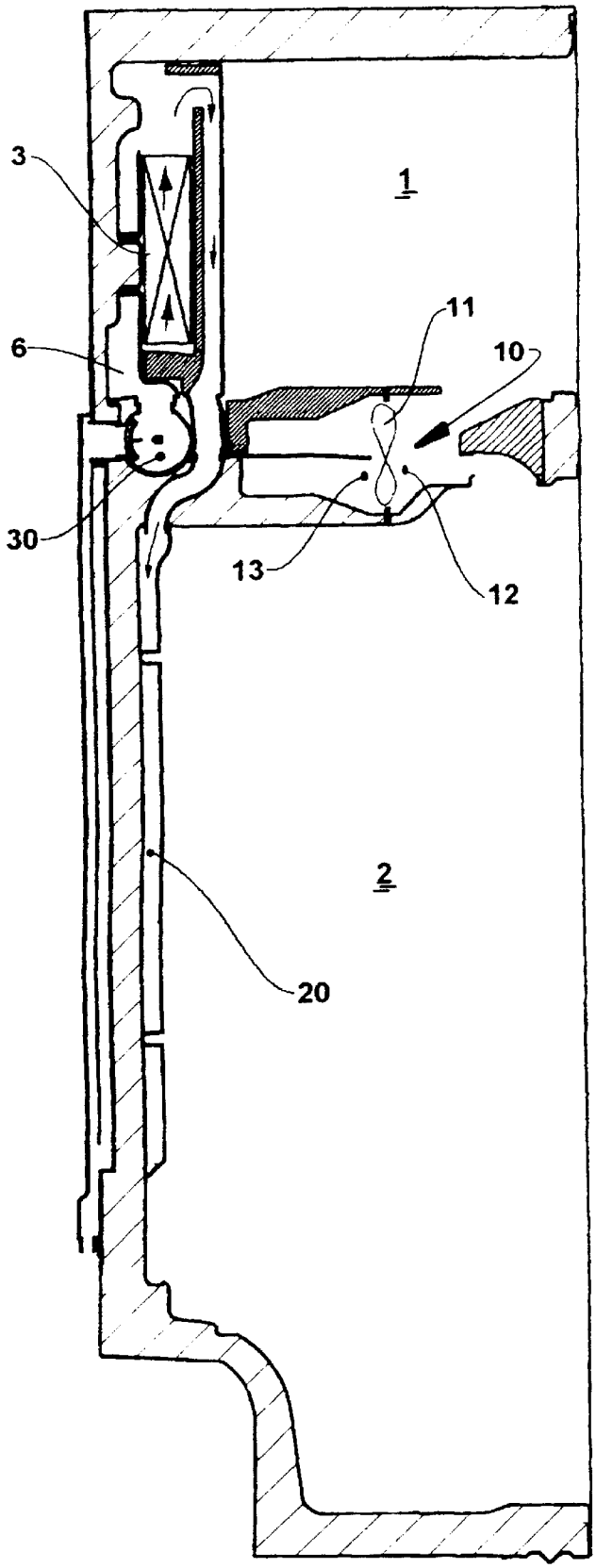
FIG. 3 illustrates, schematically and in a lateral longitudinal sectional view, according to line III—III of FIG. 1, showing the impelling means of the present invention and part of a refrigeration circuit for the freezing compartment of the refrigerator.

According to the illustrations in FIGS. 2 and 3, the inlet nozzles 21 of the refrigeration ducts 20 interconnecting each refrigeration environment 1, 2 to the air flow impelling means 10, have a substantial vertical alignment, said inlet nozzles 21 converging when they are positioned in the direction towards the respective suction chamber 12 of said air flow impelling means 10.

The air flow system of the present invention further comprises a support structure 14 carrying the fan 11 and defining part of the refrigeration ducts 20 which interconnect the discharge side of the fan to the inlet side of the evaporator portions 4, 5.

The support structure 14 has a plate portion 15 positioned substantially coplanar to the rotation axis of the fan 11 and defines a wall portion, which is common to the refrigeration ducts 20 interconnecting the discharge side of the fan 11 with the inlet side of the evaporator portions 4, 5.

The plate portion 15 defines, for each air flow, a respective deflector 16, maintaining, in a substantially axial and segregated way, each said air flow through the fan 11.

Figure 5:
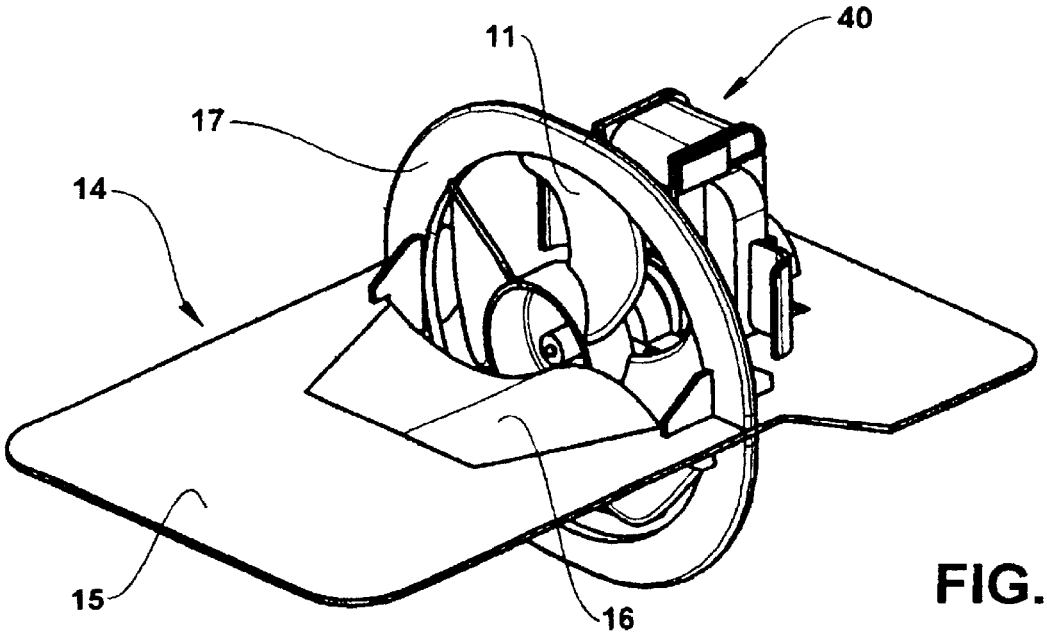
FIG. 5 illustrates, schematically and in a perspective view, a construction for the impelling means of the present invention.

In the construction illustrated in FIG. 5, the support structure 14 further has an external ring 17, which is circumferentially external to the maximum circumference defined by the external edges of the blades of the fan 11 and which circumferentially locks the support structure 40 to the body of the refrigerator cabinet.

The plate portion 15 extends to both suction and discharge sides of the fan 11 and, in its portion adjacent to the suction side, further carries a drive unit 30 for driving the fan 11.

With the refrigeration air flow system of the present invention, the refrigeration air of each environment flows between the latter and the evaporator in a substantially segregated way, with a maximum of about 5% mixture.

Thus, by varying the air flow speed and refrigeration area parameters of the respective evaporator portion, there is obtained a refrigeration of the respective refrigeration environment with more adequate temperature and humidity conditions for said environment, such as for example, a refrigeration compartment with a temperature not so cold as that of the freezing compartment and with higher humidity, which is necessary for preventing the food stored inside the freezing compartment from being cold burned.

What is claimed is:

1. An improvement in the forced air flow system for refrigerators, comprising: at least two refrigeration environments (1, 2); and a refrigeration air impelling means (10), having a suction side and a discharge side and forcing the passage of an air flow from a refrigeration environment (1, 2) through a respective evaporator portion (4, 5), each evaporator portion (4, 5) having an outlet side opened to a respective refrigeration environment (1, 2), characterized in that the refrigeration air impelling means (10) comprises only one fan (11) associated with at least two suction chambers (12), which are each opened to a respective refrigeration environment (1, 2) and to at least two discharge chambers (13), which are each opened to an inlet side (6) of a respective evaporator portion (4, 5).

2. Improvement, as in claim 1, characterized in that at least one of the suction and discharge chambers (12, 13) of the fan (11) is opened to nozzles of the respective refrigeration ducts (20) conducting to one of the parts defined by the refrigeration environments (1, 2) and the inlet side (6) of the evaporator portions (4, 5).

3. Improvement, as in claim 2, characterized in that each suction chamber (12) is axially and substantially aligned with a respective discharge chamber (13).

4. Improvement, as in claim 3, characterized in that the refrigeration ducts (20) interconnecting the fan (11) with the inlet side of the evaporator portions (4, 5) have respective inlet nozzles (21) which are vertically aligned to each other and outlet nozzles (22) which are horizontally and vertically spaced from each other.

5. Improvement, as in claim 4, characterized in that the evaporator portions (4, 5) are in the form of vertical ducts defined by at least two vertical fins (7) which are adjacent to each other and of a single evaporator (3).

6. Improvement, as in claim 5, characterized in that the evaporator (3) comprises a vertical plate (8) parallely provided between the vertical fins (7) of said evaporator (3), separating the two portions thereof.

7. Improvement, as in claim 6, characterized in that the vertical plate (8) is defined by a vertical fin (7) of the evaporator (3) having at least one end portion (9) projecting from a plane containing end edges at the same side of the other vertical fins (7) of the evaporator (3).

8. Improvement, as in claim 7, characterized in that it comprises a support structure (14) carrying the fan (11) and defining part of the refrigeration ducts (20) which interconnect the discharge side of the fan (11) to the inlet side (6) of the evaporator portions (4, 5).

9. Improvement, as in claim 8, characterized in that the support structure (14) has a plate portion (15) positioned substantially coplanar with the rotation axis of the fan (11) and defines a wall portion common to both refrigeration ducts (20) interconnecting the discharge side of the fan (11) with the inlet side (6) of the evaporator portions (4, 5).

10. Improvement, as in claim 9, characterized in that the plate portion (15) defines, for each air flow, a respective deflector (16), maintaining, in a substantial axial and segregated way, each air flow through the fan (11).

11. Improvement, as in claim 10, characterized in that each refrigeration duct (20) connecting the discharge side of the fan (11) with the inlet side (6) of the evaporator portions (4, 5) contains obturating means for selectively blocking the respective segregated air flow.

* * * * *

UNITED STATES PATENT AND TRADEMARK OFFICE

CERTIFICATE OF CORRECTION

PATENT NO. : 6,751,980 B1
DATED : June 22, 2004
INVENTOR(S) : Luiz A. Lopes

It is certified that error appears in the above-identified patent and that said Letters Patent is hereby corrected as shown below:

Title page,
Item [75], Inventors, please delete "Luiz Antonio Diemer Lopes, Joinville, SC (US)" and substitute -- Luiz Antonio Diemer Lopes, Joinville, SC (BR) --.

Signed and Sealed this

Fifth Day of October, 2004

JON W. DUDAS
*Director of the United States Patent and Trademark Office*